US005283980A

United States Patent [19]

Lohrenz et al.

[11] Patent Number: 5,283,980

[45] Date of Patent: Feb. 8, 1994

[54] LENS BLOCKER

[75] Inventors: Marold H. Lohrenz; Richard W. Pembroke, both of Tulsa, Okla.

[73] Assignee: Coburn Optical Industries, Inc., Tulsa, Okla.

[21] Appl. No.: 985,897

[22] Filed: Dec. 4, 1992

[51] Int. Cl.[5] ..... B24B 49/00

[52] U.S. Cl. ..... 51/165.72; 51/216 LP; 51/165.71

[58] Field of Search ..... 51/165 R, 165.71, 165.72, 51/216 LP, 235

[56] References Cited

U.S. PATENT DOCUMENTS

| | | | |
|---|---|---|---|
| 4,330,203 | 5/1982 | Oppenheim et al. | 51/216 LP |
| 4,677,729 | 7/1987 | Morland et al. | 51/216 LP |
| 4,723,376 | 2/1988 | Blum et al. | 51/165.72 |
| 4,737,918 | 4/1988 | Langlois et al. | 51/165.71 |
| 4,794,736 | 1/1989 | Fuwa et al. | 51/165.72 |
| 4,936,056 | 6/1990 | Gaudel et al. | 51/216 LP |

*Primary Examiner*—M. Rachuba
*Attorney, Agent, or Firm*—Catalano, Zingerman & McKay

[57] ABSTRACT

A computer is used to calculate the location of a target, customize the target to conform to the lens, frame and patient characteristics of each individual job and automatically compensate for parallax in the apparatus. A convenient open work surface is provided for the operator to position the lens blank on a non-skid surface. The block is applied at a constant limited force in a manual or automatic mode of operation on either frame or optical center. The offsets for positioning the lens blank are calculated within the blocker based upon frame and patient data. This data can be input directly or can be downloaded from a database. These offsets determine the location of the target relative to the optical markings on the lens blank. The amount the target is offset is scaled automatically to compensate for the fact that the lens blanks are on a work surface above the electronic display. A customized target is displayed. The target is scaled to match the segment widths for multi-focal lenses, and provides a centered target location with multiple horizontal lines for single vision lenses, including progressive lenses. Scaling of the width eliminates operator judgement to "eyeball" the center. The multiple horizontal lines provide an additional aid in aligning progressive lenses where the distance from the "mounting cross" to the horizontal line on the lens blank varies by manufacturer. The frame shape may also be displayed to provide a sense of fit.

25 Claims, 9 Drawing Sheets

LENS BLOCKER

BACKGROUND OF THE INVENTION

This invention relates generally to optical equipment and more particularly concerns apparata for applying a block on a lens blank in preparation for mounting on a grinder.

The placement of a block on a lens must be accurate if the lens is to be correctly positioned in the frame to match the prescription of the patient.

To accomplish this placement, existing blocker type devices presently provide for entering data, displaying a target, displaying the spectacle rim shape and applying the block. However, computations within blockers are minimal. Targets are of a fixed shape with allowance for particular job requirements and judgement is required of the operator to center marks on the lens blank relative to the target. In some cases, clamping devices are used to hold the lens blank. Manually operated blockers are subject to a varying force when the block is applied to the lens blank.

It is therefore an object of this invention to provide a lens blocker which minimizes the need for operator judgment in blocking a lens. It is a further object of this invention to provide a lens blocker which routinely leads an operator through a target customizing process to tailor the target placement and/or configuration to the individual lens, patient and frame characteristics of each job. Another object of this invention is to provide a lens blocker which applies a constant, limited force to the lens during the blocking process. And it is an object of this invention to provide a lens blocker which operates in a variety of modes for direct operator input for calculating the placement of the block based on operator input, or so as to receive frame and/or patient data from measuring equipment and/or from a database. A further object of this invention is to provide a lens blocker that automatically compensates for parallax. Yet another object of this invention is to provide a lens blocker which will allow the operator to confirm the accurate location of the segment relative to the optical center in a multi-focal lens.

SUMMARY OF THE INVENTION

In accordance with this invention, a computer is used to calculate the location of the target, to customize the target to conform to the lens, frame and patient characteristics of each individual job and to automatically compensate for parallax in the apparatus. A convenient open work surface is provided for the operator to position the lens blank. The block is applied at a constant force in a manual or automatic mode of operation. The offsets for positioning the lens blank ar calculated within the blocker based upon frame and patient data. This data can be input directly or can be downloaded from a database. These offsets determine the location of the target relative to the optical markings on the lens blank. A customized target is displayed. The target is scaled to match the segment widths for multi-focal lenses, and provides a centered target location with multiple horizontal lines for single vision lens, including progressive lenses. Scaling of the width eliminates operator judgment to "eyeball" the center. The multiple horizontal lines provide an additional aid in aligning progressive lenses where the distance from the "mounting cross" to the horizontal line on the lens bank varies by manufacturer.

The amount the target is offset is scaled automatically to compensate for the fact that the lens blanks are on a work surface above the electronic display. As the viewing angle moves off vertical for larger offsets, the image on the display must be moved further to represent the desired location on the lens blank.

This calculation, in the present implementation, provides for automatic compensation of the off-vertical viewing, the light refractions in the work surfaces and support materials, and the light refraction in an "average" lens. Further compensating calculations could be incorporated for lenses with extreme corrective properties. For example, variations for lens powers other than "average" and lenses with prescription prisms could be compensated.

An open user-friendly work space is provided for the operator to position the lens blank to align the markings on the lens blank to the target. The lens blank rests on a non-skid surface above the display. The lens is easily moved yet restrained from accidental movements. The target and an image of the frame shape are displayed, thereby providing a sense of fit.

Blocking can be on frame center FC or optical center OC. For FC, the blank is positioned to the target and the block applied. A visual check that the lens blank overlays the frame shape can be made. For OC blocking, the lens blank is positioned to the target. If it is desired to make the visual check, a second optical center target BOC is displayed enabling the operator to verify the positioning of the cut-out in the lens.

The force to apply the block to the lens blank is controlled for manual and automatic modes of operation. A blocking arm is moved to a hard stop and a compliant component on the arm is used to provide a load limited or constant force to the lens independent of the height of the lens blank.

DESCRIPTION OF THE DRAWINGS

Other objects and advantages of the invention will become apparent upon reading the following detailed description and upon reference to the drawings in which.

While the invention will be described in connection with a preferred embodiment and procedure, it will be understood that it is not intended to limit the invention to that embodiment or procedure. On the contrary, it is intended to cover all alternatives, modifications and equivalents as may be included within the spirit and scope of the invention as defined by the appended claims.

DETAILED DESCRIPTION OF THE INVENTION

Figure 6:
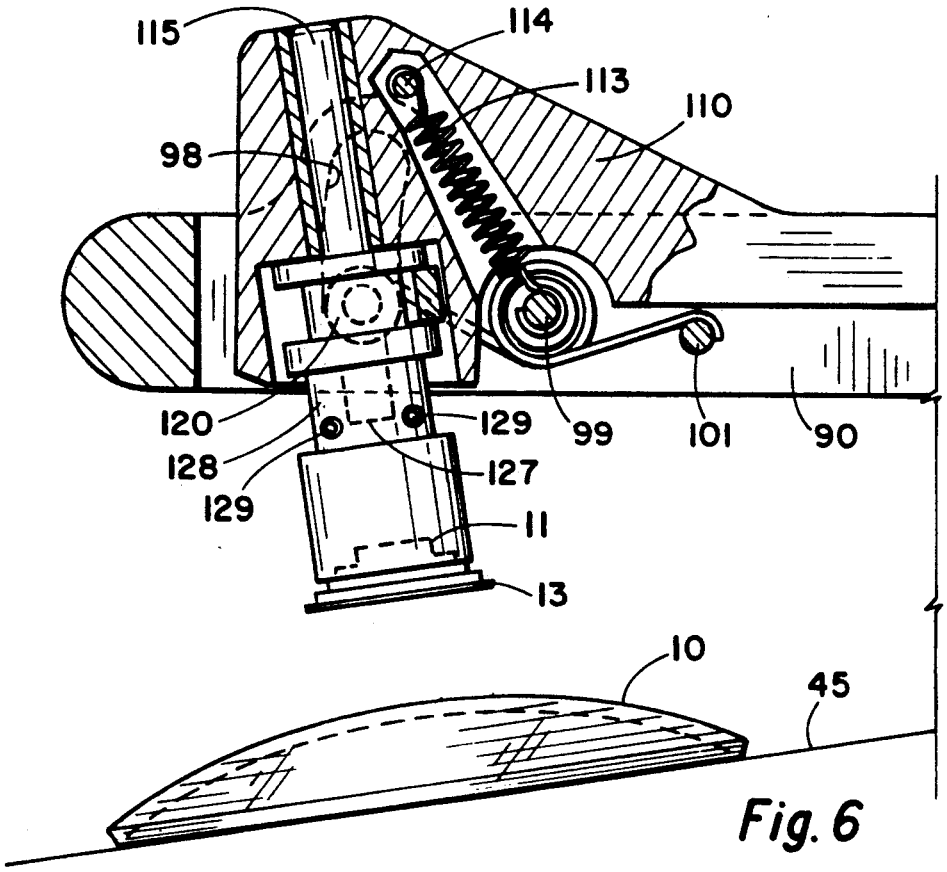
FIG. 6 is a cross-sectional view of a forward segment of the blocker arm of the lens blocker of FIG. 1 taken along a vertical plane through the longitudinal axis of the blocker arm and illustrating the position of the blocker arm components as the grinding block approaches the lens.

Turning first to FIG. 6, an eyeglass lens blank 10 which is to be ground to fit the rim of a frame (not shown) will have a grinding block 11 fixed to its surface at a precisely determined location by use of a double stick binding strip 13 disposed between the lens surface 10 and the grinding block 11.

Figure 1:
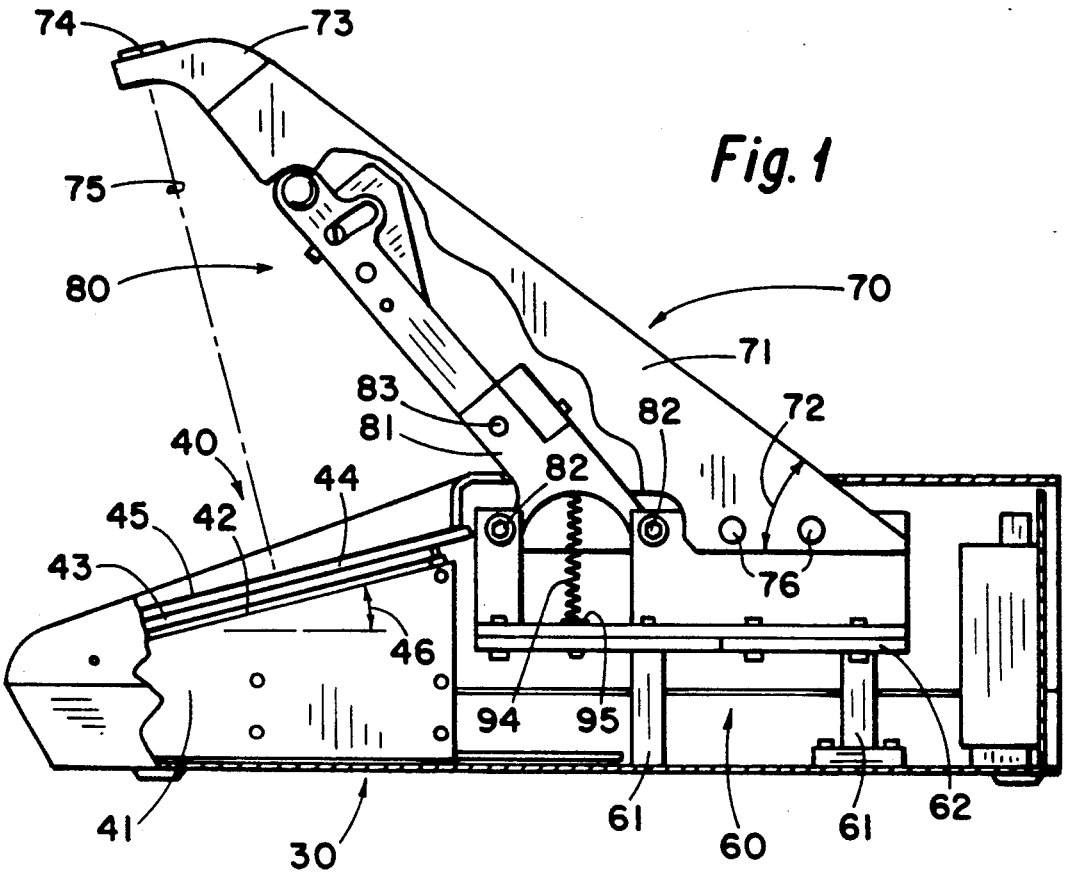
FIG. 1 is a side elevation view with parts broken away of a preferred embodiment of the lens blocker.

A preferred embodiment of a lens blocker for use in accurately placing the block 11 on the lens 10 is illustrated in FIG. 1. The blocker consists of a housing 30 with a work surface 40 on an upper forward portion of the housing 30. The housing 30 contains the control circuit components 50, illustrated in block form in FIG. 9, which determine the display visibly presented on the work surface 40. The housing also encloses a frame 60 which supports the alignment tower 70 and blocker arms 80 which extend through the housing 30 above the work surface 40.

As can best be seen in FIGS. 1 and 10 through 14, the work surface 40 includes a mounting bracket 41 which supports a circuit board 42 above which lies an LCD 43. The LCD 43 is covered by a viewing glass 44 which is in turn covered by a sheet 45 of non-slip material to insure that a lens 10 placed on the work surface 40 will not slide on the work surface 40 during the lens blocking process. As shown, the work surface 40 lies at an angle 46 suitable to the comfort of the operator, preferably at an angle of approximately ten to fifteen degrees. The work surface 4 further includes a plurality of keys 47A through 47N, as shown disposed adjacent the front and right portions of the work surface 40.

Figure 9:
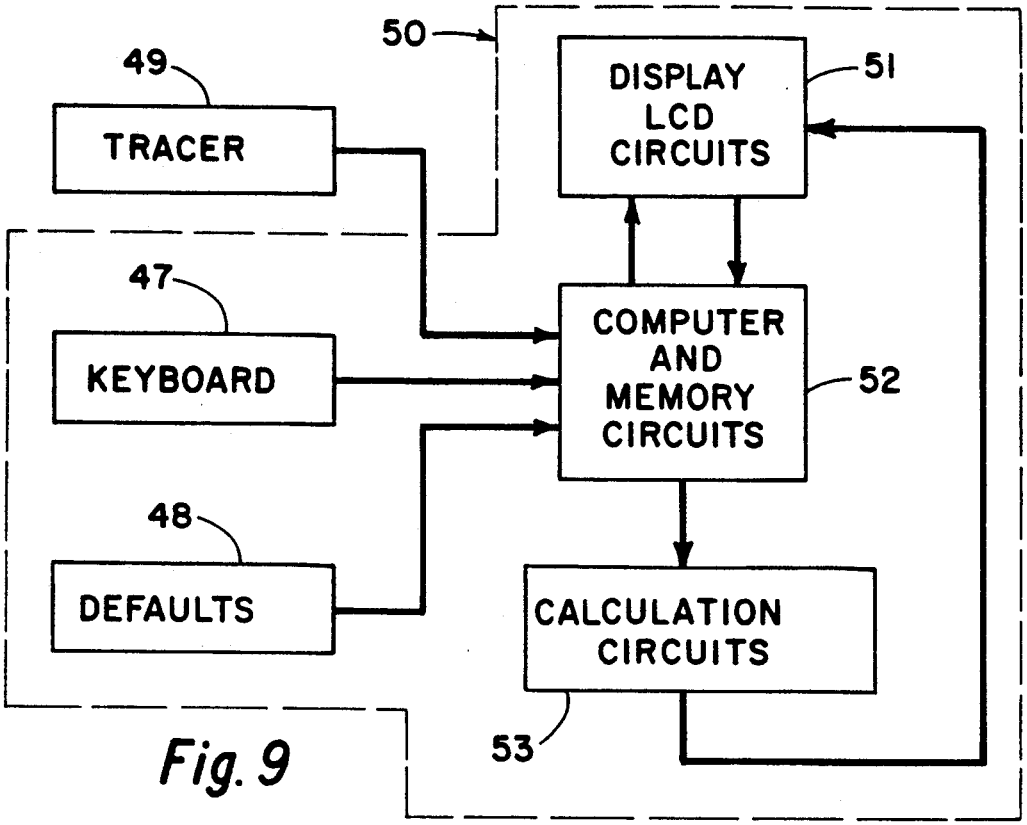
FIG. 9 is as block diagram illustrating the control circuit components of the lens blocker of FIG. 1.
Figure 10:
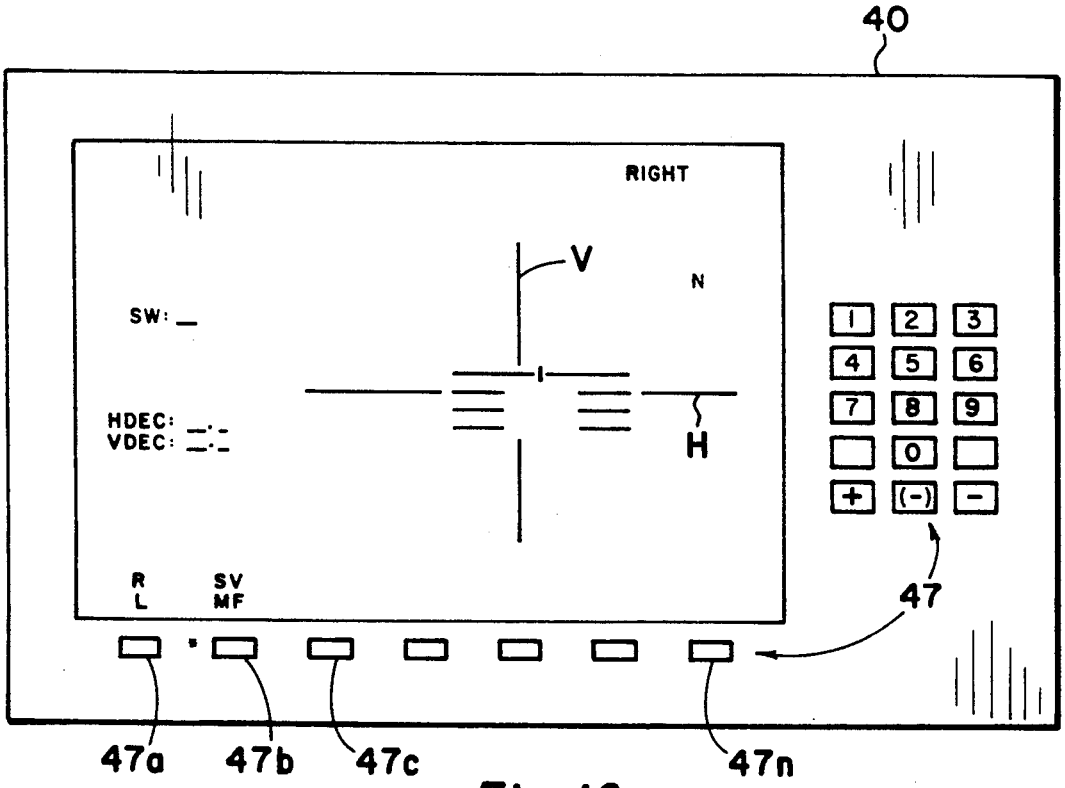
FIG. 10 is a reduced replica of the display screen image which appears on the lens blocker screen when the operator has selected a right, single-vision lens target for use in the job ticket mode of the lens blocker.
Figure 11:
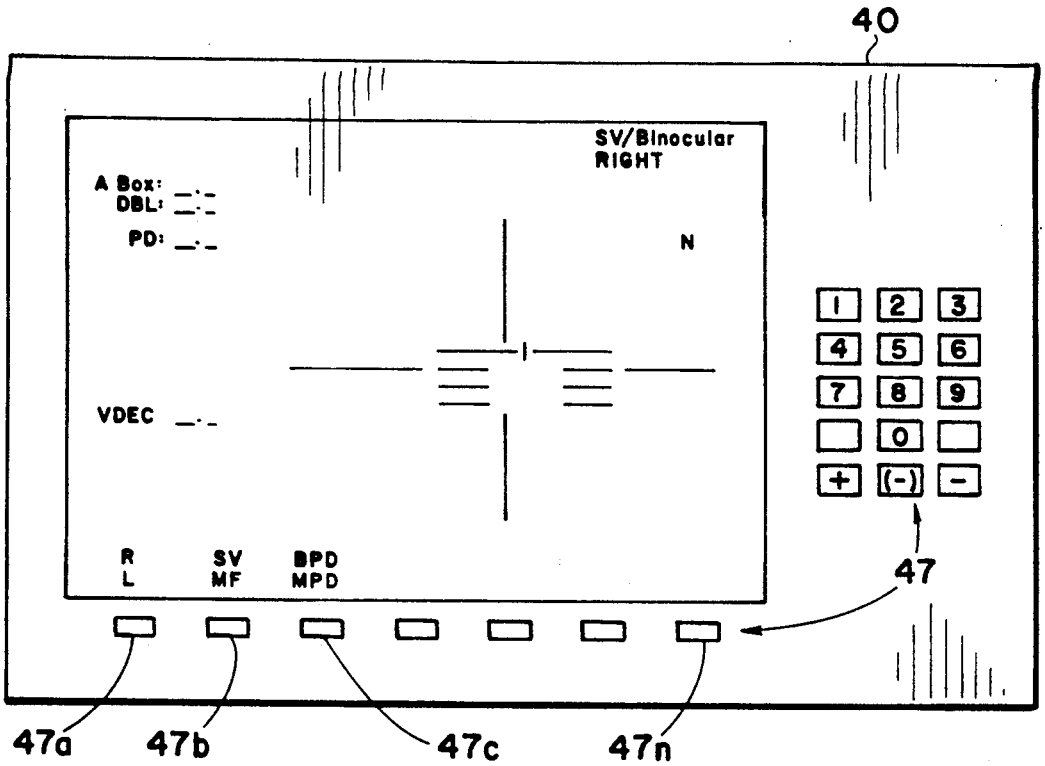
FIG. 11 is a reduced replica of the display screen image which appears on the lens blocker screen when the operator has selected right single-vision lens target for use in a binocular pupillary distance application in the patient Rx mode.

Turning to FIG. 9, the control circuit components 50 include the display circuits 51, the computer and memory circuits 52 and the calculation circuits 53. The inputs to the computer and memory circuits 52 may consist of local override and patient input data from the keyboard 47 containing the keys 47A through 47N on the blocker. In addition, data can be introduced to the computer and memory circuits 52 via shop defaults 48. Finally, frame data accumulated by a tracer 49 can be introduced directly to the computer and memory circuits 52.

Figure 15:
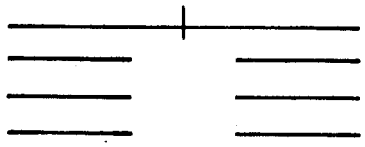
FIG. 15 is an illustration of the target that will be displayed on the lens blocker screen when the operator selects a single-vision lens.
Figure 16:
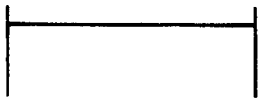
FIG. 16 is an illustration of the target that will be displayed on the lens blocker screen when the operator selects a multi-focal lens.

The control circuit components 50 are arranged to operate in either a job ticket mode, a patient Rx mode or an on-line mode. The on-screen image appearing on the display 51 is in the job ticket mode and includes the prompts illustrated in FIG. 10. As shown, key 47A allows the operator to select the right R or left L lens for blocking. As shown in the upper right hand corner of the screen, the "right" lens has been selected and therefore the display indicates for reference that nasal N will be to the right of the vertical grid line V. By toggling the key 47A, the left lens would be selected and the word "left" would appear in the upper right hand corner of the screen and the nasal N would be displayed to the left of the vertical grid line V. Using the key 47B, the operator next selects a target suited to a single vision lens SV or a multi-focal lens MF. Looking at FIGS. 15 and 16, the possible targets to be displayed on the screen are illustrated. FIG. 15 illustrates the target associated with single vision and progressive lenses SV. FIG. 16 illustrates the target associated with multi focal lenses MF. Returning to FIG. 10, a single vision lens SV has been selected by the operator and the target of FIG. 10 is seen to overlay vertical V and horizontal H gridlines on the display. The operator can then enter the horizontal decentralization HDEC and vertical decentralization VDEC directly using the numeral keys of the keyboard 47. Entry of a positive horizontal decentralization HDEC will cause the target to shift toward nasal N as shown and entry of a positive vertical decentralization VDEC will cause the target to shift up in relation to the horizontal gridline H, as shown. The use of negative values for horizontal and vertical decentralization would cause the target to move away from nasal N and downwardly in relation to the horizontal gridline H. Once the target has been properly shifted in the job ticket mode, the display is ready for use in locating the block 13 on the lens 10. The SW field shown on the screen appears only when the operator selects MF operation, in which case lens seg-width is input by the operator to customize the vertical line spacing on the MF target shown in FIG. 18.

If the operator desires to operate the system in the patient Rx mode, the operator switches from the job ticket screen to a menu screen which then enables the operator to select either the patient Rx or on-line mode. Upon selection of the patient Rx mode, the display illustrated in FIG. 11 will appear on the screen. In the patient Rx mode, the operation of selecting right or left lenses and selecting single-vision and multi-focal lenses is the same as in the job ticket mode. If the single-vision lens is selected, the operator is also given the choice between binocular pupillary distance BPD and monocular pupillary distance MPD which relates the relative symmetry of the eyeglass wearer and the frame. If the binocular BPD selection is made by toggling key 47C, as appears on the screen as SV/Binocular, a single set of input dimensions will be used to determine the positioning of the target for both frames. In a monocular pupillary distance MPD selection, two sets of data will be used to separately locate the target for each lens so as to compensate more accurately for variations in the physical symmetry of the wearer and the physical structure of the frame. In the patent Rx mode, the horizontal decentralization HDEC is automatically calculated by the calculator 53 based on the patient data input but is not displayed. With the cursor at the first digit of the A Box field, which is the width of the rim or data is entered, the system automatically steps through the distance between lenses DBL field, the pupillary distance PD field and the vertical decentralization VDEC field and then returns to the A Box field. The target is updated and shifted when the vertical decentralization VDEC data is entered. The operator can adjust the system or "cheat" by varying the PD field. Had the monocular pupillary distance MPD been selected by the operator, then the upper right hand corner of the screen would display SV/Monocular and the PD field to the left of the screen would appear as an MPD field. In this condition, the data inserted for each field would be separately calculated for the left and right lenses.

Figure 12:
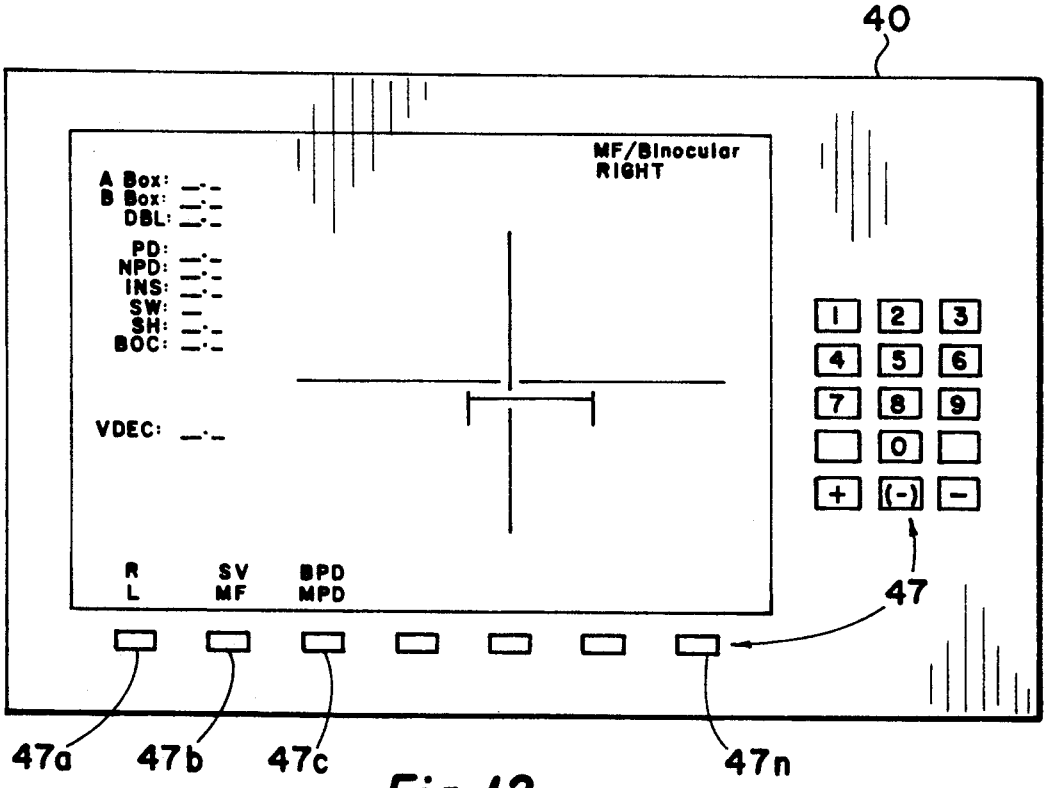
FIG. 12 is a reduced replica of the display screen image which appears on the lens blocker screen when the operator has selected a right, multi-focal lens target for use in a binocular pupillary distance application in the patient Rx mode.
Figure 18:
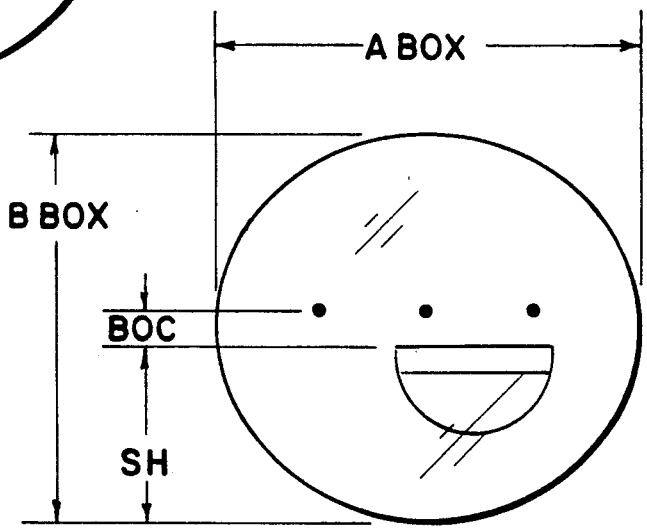
FIG. 18 illustrates the alignment markings appearing on a typical multi-focal lens.

FIG. 12 illustrates the screen image when the operator selects the patient Rx mode and a multi-focal MF lens target as shown in FIG. 18 for binocular pupillary distance BPD operation. As shown, the operator has selected the right lens R, multi-focal MF lens and binocular pupillary distance BPD. The A Box field displays the width of the rim, the B Box field displays the height of the rim and the DBL field displays the distance between lenses. The PD field illustrates the pupillary distance for far vision, the NPD field illustrates the near pupil distance for a near vision bifocal and the INS field represents one-half the difference between the pupillary distance PD and the near pupillary distance NPD. The SW field represents the seg-width or width of the bifocal portion of the lens, the SH field represents the seg-height of distance from the bottom of the lens to the top of the bifocal portion of the lens and the BOC field represents the optical center of the lens. The system operates as before described for SV/Binocular operation but the BOC field displays the distance below optical center, or the distance between the desired optical center of the lens and the top of the bifocal portion of the lens for reasons to be explained hereinafter.

Figure 13:
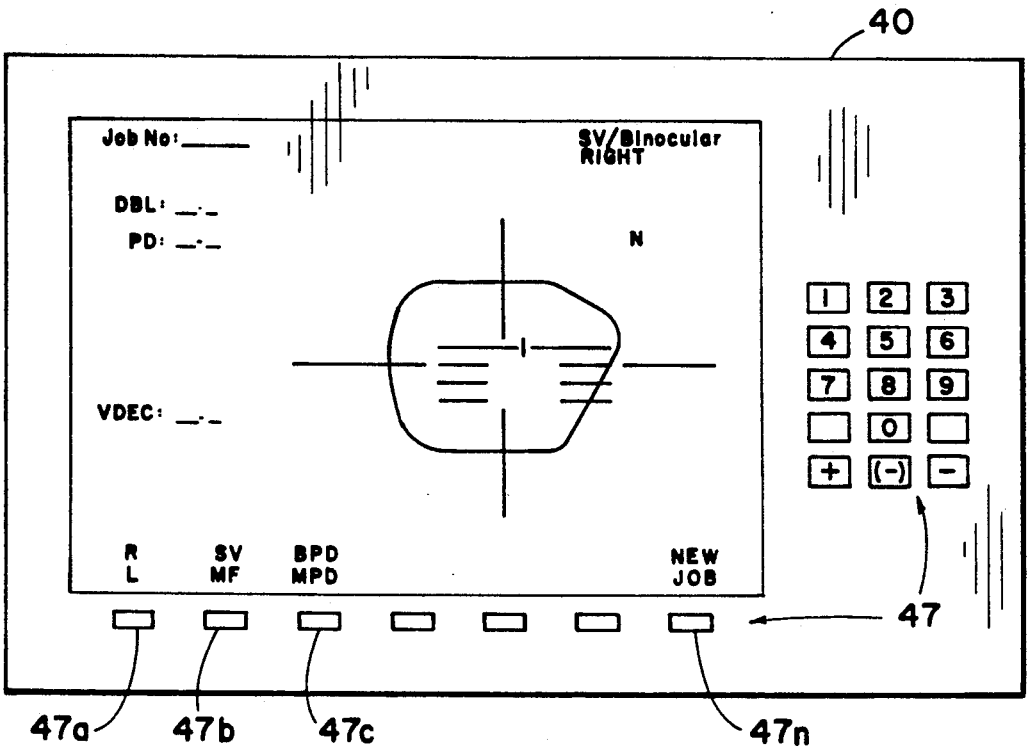
FIG. 13 is a reduced replica of the display screen image which appears on the lens blocker screen when the operator has selected a right, single-vision lens target for use in a binocular pupillary distance application in the on-line mode.
Figure 14:
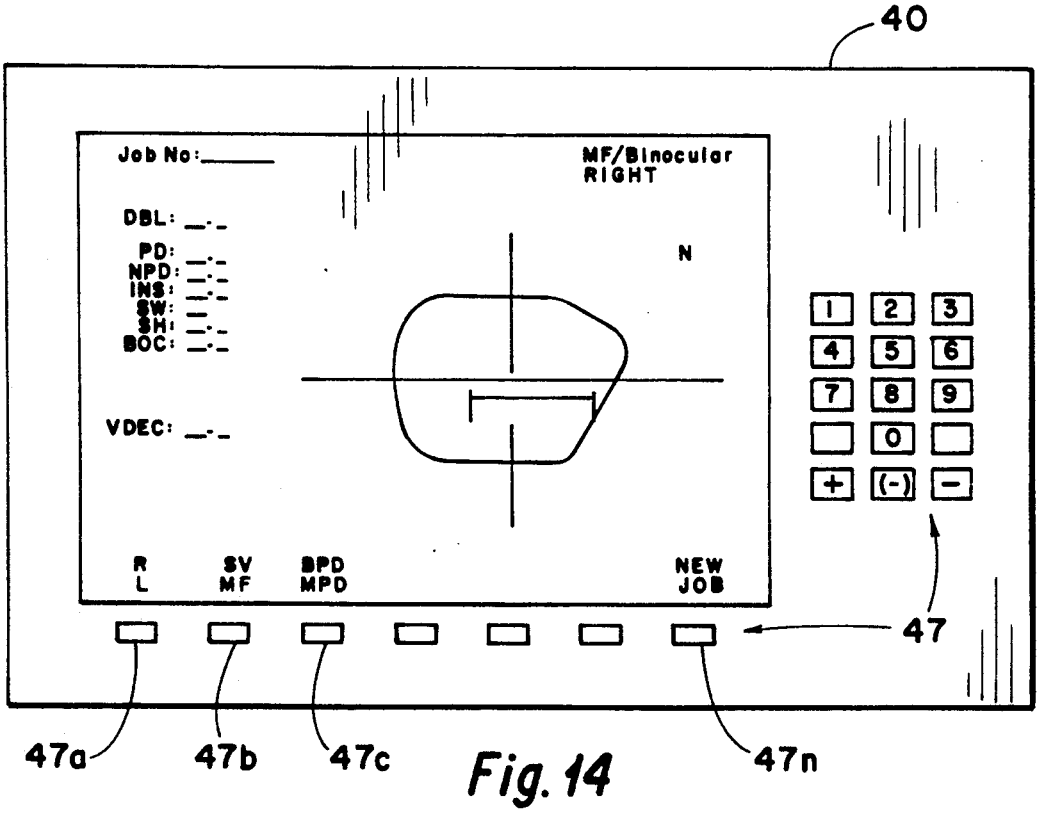
FIG. 14 is a reduced replica of the display screen image which appears on the lens blocker when the operator has selected a right multi-focal lens target for use in a binocular pupillary distance application in the on-line mode.

If the operator selects the on-line mode from the menu, the screen display will appear as shown in FIGS. 13 and 14. As shown in FIG. 13, for a right, single-vision lens and a binocular polar pupillary distance, the SV/Binocular, RIGHT, nasal N, and grid are automatically displayed. In addition, the on-line input from the tracer 49 or other input source will cause the shape of the selected lens rim to be displayed on the screen from the patient's point of view. The horizontal decentralization HDEC is automatically calculated but not displayed. The cursor will step through the vertical decentralization VDEC field to the DBL field to the PD field and the target will be updated and moved at the entry of this data. The operator can vary the PD field to "cheat" or manipulate the target and further can override the DBL field via the override inputs to the computer and memory circuits 52. Thus, by use of the on-line mode with the shape displayed, the operator is able to confirm whether a lens properly centered on a accurately located target will properly fit within the frame rim selected by the patient. FIG. 14 illustrates the on-line mode for MF/Binocular operation.

Figure 17:
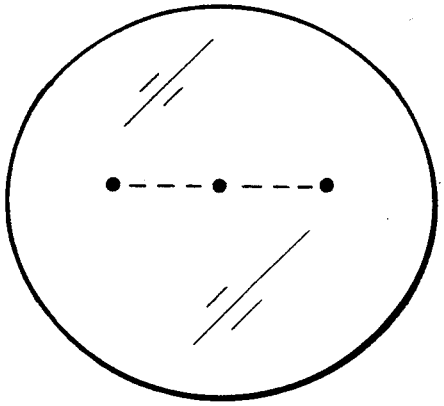
FIG. 17 illustrates the alignment markings appearing on a typical single-vision lens.
Figure 19:
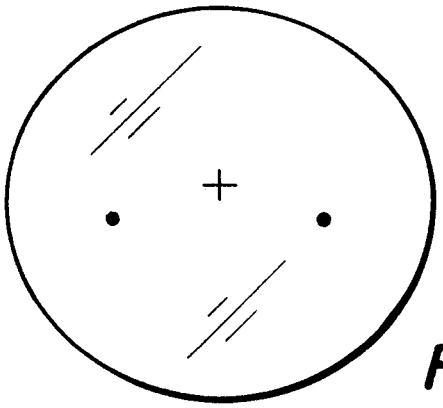
FIG. 19 illustrates the alignment markings appearing on a typical progressive lens.

Typical lens blanks are illustrated in FIGS. 17 through 19. A single vision lens blank is illustrated in FIG. 17. The SV lens is characterized by three dots appearing on a horizontal line with the central dot being located at the optical center of the lens and the other dots being spaced equally distant to either side and on the horizontal axis of the blank. A progressive lens is illustrated in FIG. 19 and is characterized in that the optical center of the lens is indicated by a mounting cross and the dots on either side of center are downwardly displaced, typically two, four or six millimeters depending on the lens manufacturer. These distances corresponding to the lower lines displayed on the SV lens target as shown in FIG. 15. A multi-focal lens is illustrated in FIG. 18 and includes the bifocal or trifocal half moon beneath the bifocal and trifocal horizontal lines. The width of the target is adjusted to the width of the multi-focal segment, thereby providing a precise aid for aligning the lens blank. In addition, the multi-focal lens may include three dots as appear on the single vision lens with the center dot marking the optical center of the lens. When the multi-focal lens is selected and the BOC field data applied, alignment of the optical center displayed on the screen as part of the target with the optical center marked on the multi-focal lens will confirm to the operator that the lens maker has properly located the bifocal portion of the lens in relation to the optical center of the lens.

Given the above typical examples of the system in the job ticket mode, the patient Rx mode and the on-line mode together with the possible selections of single vision and multi-focal lenses as well as binocular and monocular pupillary distances, the permutations of screen displays available to the operator will be readily apparent. The data may be entered in a variety of ways known in the computer arts. The system may provide for different prompts and progressions of prompts by the operator. The embodiment described is desirable in that, in practice, it leads the operator step-by-step through the operation with minimal calculations and inputs required on the part of the operator.

In sum with respect to the display portion of the blocker, the job ticket mode enables the blocker to operate as a stand alone unit independent of other data sources in which the operator can properly display an accurate target relative to the decentration data input by the operator. In the patient Rx mode, the operator can input patient data and frame data, and then the blocker will automatically calculate, update and shift the target to take into account individual patient characteristics. In the on-line mode, the operator is able to automatically display the frame on the screen based on data obtained from a tracer 49 to confirm the appropriateness of a selected lens.

It should be further noted that the calculation circuits 53 compute offsets for the target displayed relative to the parallax effect of the work surface. That is, the lens 10, the viewing glass 44 and the nonslip sheet 45 have individual refraction characteristics which will cause the target displayed by the LCD 43 to be misaligned by the operator observing that target from a vantage point above the lens 10, the nonslip sheet 45 and the viewing glass 44. Consequently, adjustments to correct the parallax by shifting the target to account for the error are built into the calculation circuits 53.

Once the target is accurately displayed by the LCD 43 through the work surface 40, the operator lays the appropriate lens on the non-skid sheet 45 on work surface 40 and manipulates the lens 10 so that the appropriate alignment markings illustrated in FIGS. 17 through 19 are properly aligned with the target displayed as a permutation of the typical targets illustrated in FIGS. 10 through 14. This is done by use of a peephole sight line 75 as will hereinafter be explained. With the lens 10 thus positioned on the nonslip sheet 45, the operator is ready to manipulate the mechanical portion of the blocker to accurately place the grinding block 13 on the lens 10.

Returning to FIG. 1, the blocker support frame 60, in the embodiment illustrated, consists of vertical support columns 61 which support a horizontal plate 62 which in turn supports a pair of upright brackets 63. The brackets 63 support an alignment tower 70 and blocker arms 80 which extend from the support frame 60 upwardly and forwardly above the work surface 40.

The alignment tower 70 consists of an elongated member 71 extending at an angle 72 of from thirty to fifty degrees upwardly and forwardly from the support frame 60 to a peep hole assembly 73. The assembly 73 supports a peep hole 74 in a position such that an operator looks down through the peep hole 74 along a sight line 75 substantially aligning the peep hole 74 with the geometric center of the viewing glass 44 with the sightline 75 being perpendicular thereto. As shown, the alignment tower 70 is secured to the support frame 60 by the use of bolts 76 extending through the lower portion of the alignment tower 70 and the mounting brackets 63. The blocker arm assembly 80 is secured to the support frame 60 by use of a seat bracket 81 connected to the mounting brackets 63 by bolts 82.

Figure 2:
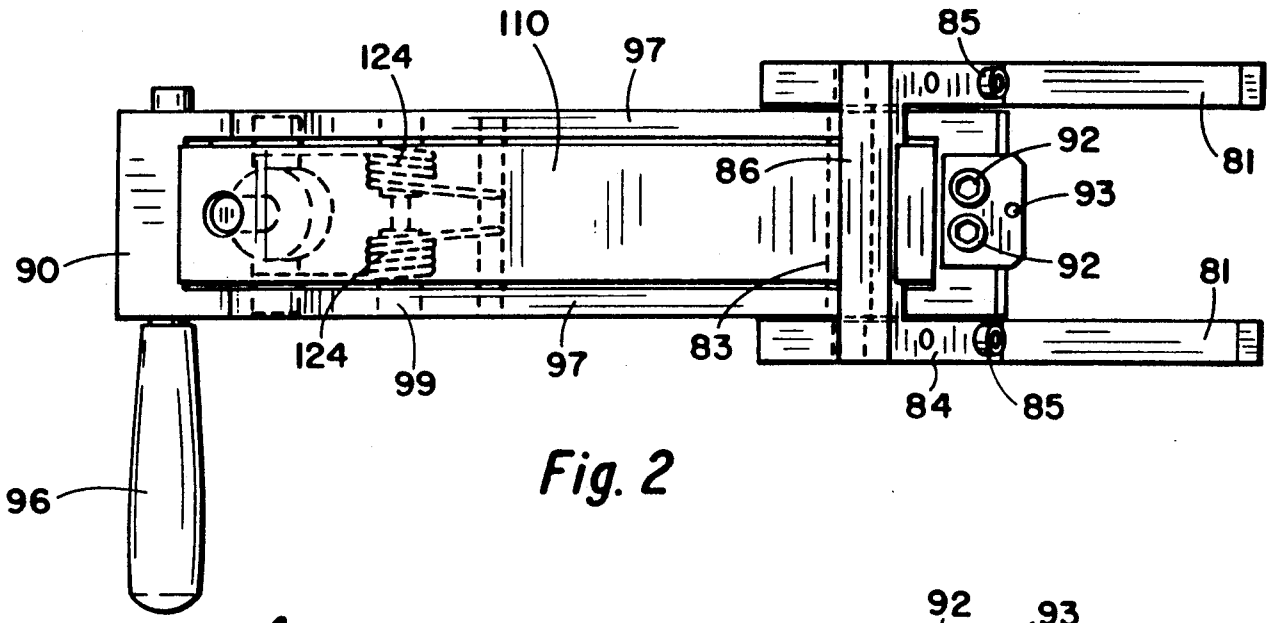
FIG. 2 is a top plan view of the blocker arm of the lens blocker of FIG. 1 in a downwardly rotated position.
Figure 3:
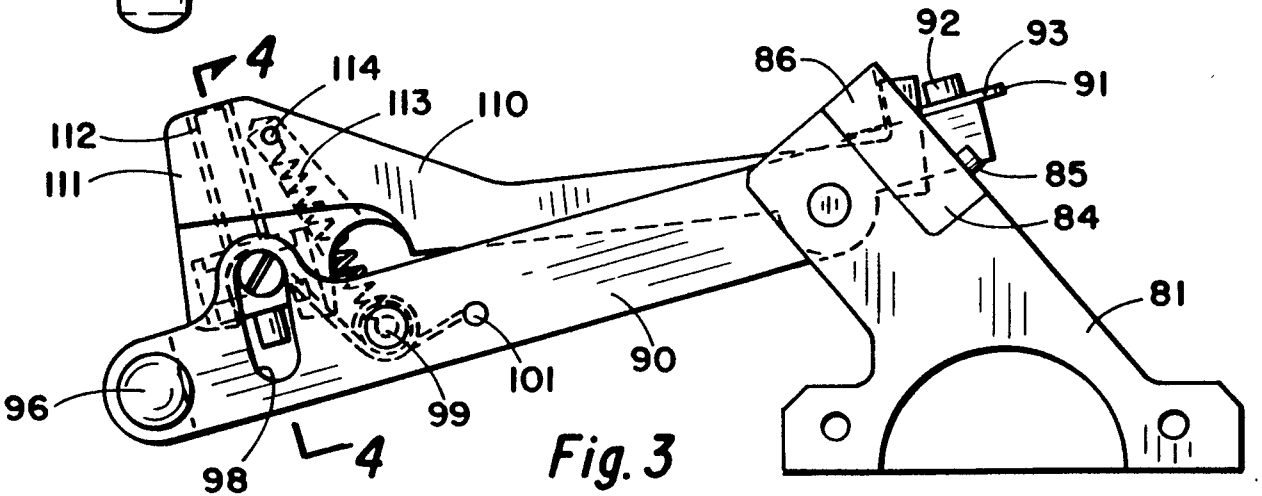
FIG. 3 is a side elevation view of the blocker arm in the position illustrated in FIG. 2.

Turning now to FIGS. 2 and 3, the blocker arms 80 are illustrated in more detail. The seat bracket 81 extends upwardly and forwardly from the support frame 60 to a pivot pin 83 extending transversely across the open portion of the bracket 81. A stop block 84 mounted on the upper portion of the seat bracket 81 by use of screws 85 is milled to provide a stop bar 86 which extends across the bracket 81 above and rearwardly of the pivot pin 83 and positioned for a purpose hereinafter described.

The blocker arms 80 include an exterior blocking arm 90 journalled toward the rear end thereof on the pivot pin 86 and an internal compliant arm 110 also journalled at a rear portion thereof on the pivot pin 86, so that the compliant arm 110 and the blocking arm 90 both rotate about the pin 86 independently of each other. A plate 91 fastened to the upper rear portion of the blocking arm 90 by screws 92 extends rearwardly of the blocking arm 90 and has an aperture 93 extending through it. A helical spring 94 shown in FIG. 1 is connected between the aperture 93 and a connector 95 and biases the exterior blocking arm 90 towards its maximum upward rotation illustrated in FIG. 1. As can best be seen in FIG. 3, when the handle 96 is used to rotate the forward portion of the exterior blocking arm 90 downwardly against the bias of the helical spring 94, the exterior blocking arm 90 will rotate downwardly until its rear portion rises sufficiently to make contact with the underside of the stop bar 86 which prevents further rotation of the exterior blocking arm 90 toward the work surface 40. The outer walls 97 of the exterior blocking arm 90 are provided with arcuate slots 98 radially displaced from the pivot pin 83 proximate the forward end of the exterior blocking arm 90. A torsion pin 99 extends between the outer walls 97 transversely across the exterior blocking arm 90 at a radial distance from the pivot pin 83 less than the distance from the pivot pin 83 to the arcuate slots 98. A limit pin 101 also extends transversely across the exterior blocking arm 90 between the torsion pin 99 and the pivot pin 83.

The interior compliant arm 110 widens vertically at its free end to form a housing portion 111 having a cylindrical bearing 112 with the longitudinal axis of the bearing being so aligned through the housing 112 as to be perpendicular to the work surface 40 when the interior compliant arm 110 is rotated downwardly to substantially the block application level of its angular path as will hereinafter be explained. The interior compliant arm 110 is biased for downward rotation with the exterior blocking arm 90 by a helical spring 113 which is connected from a narrow portion 102 at the center of the torsion pin 99, as can best be seen in FIG. 4, to a connecting pin 114 extending transversely across the housing portion 111 of the interior compliant arm 110. Thus, as the exterior blocking arm 90 is downwardly rotated by use of the handle 96, the tension in the helical spring 113 causes the interior compliant arm 110 to move downwardly in unison with the exterior blocking arm 90.

Figure 4:
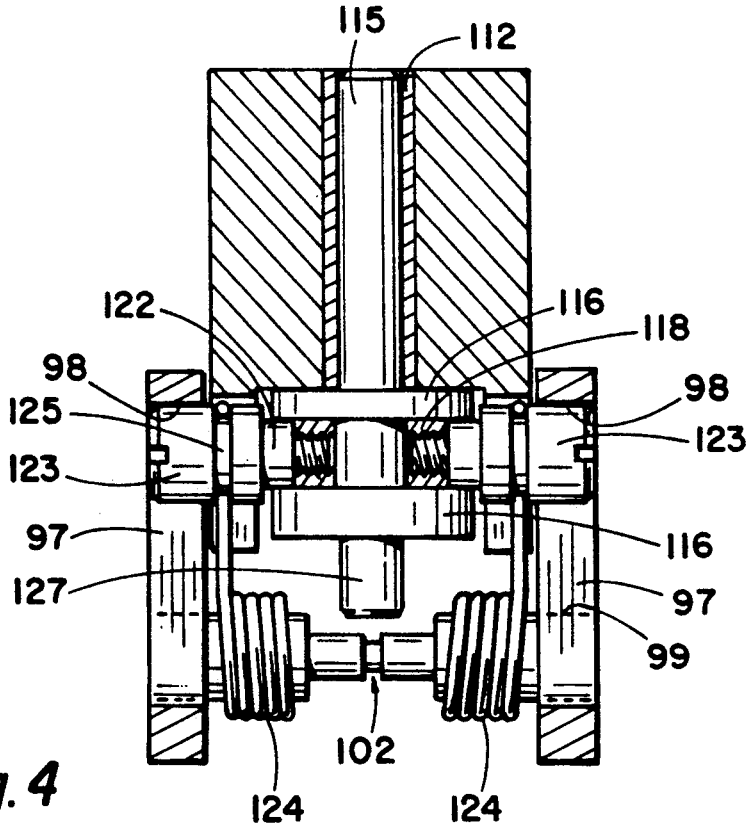
FIG. 4 is a cross-sectional view taken along the line 4–4 of FIG. 3.
Figure 5:
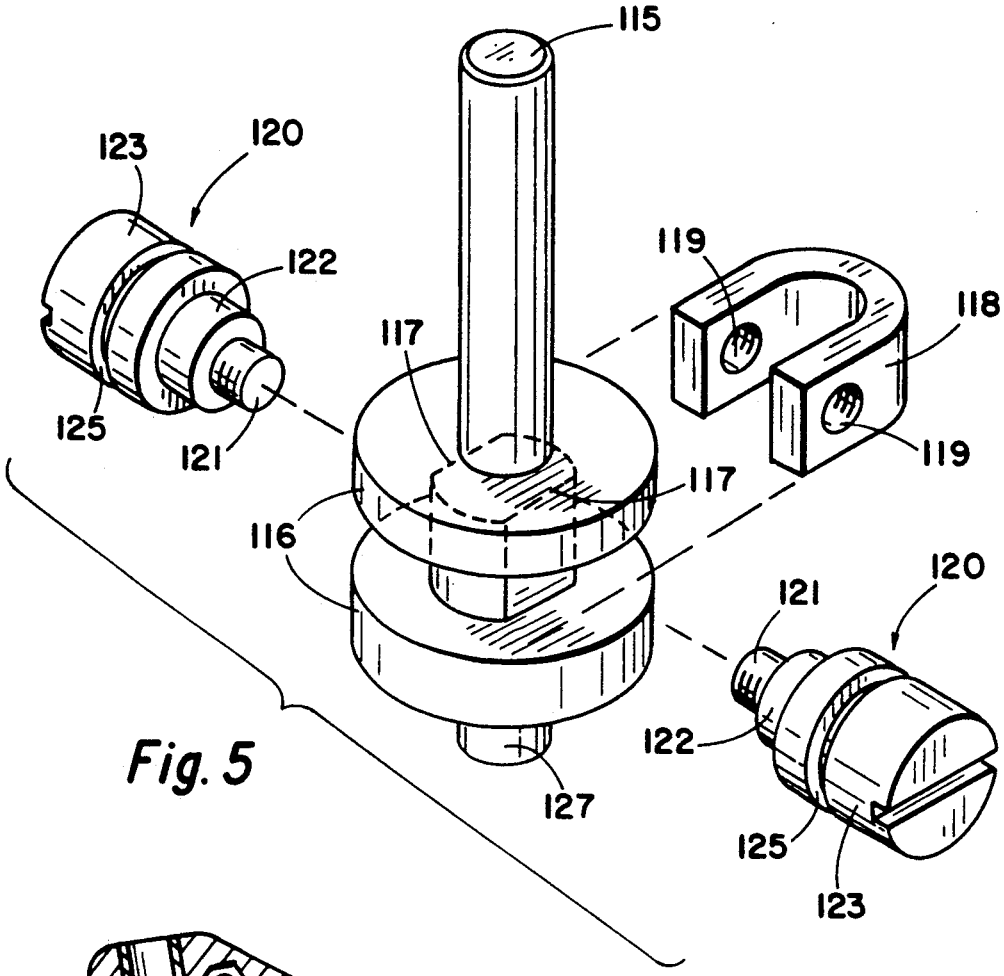
FIG. 5 is a perspective view of the component parts of the sliding rod assembly of the lens blocker of FIG. 1 aligned for assembly.

As can best be seen in FIGS. 4 and 5, a sliding rod 115 extends through the cylindrical bearing 112, the lower portion of the rod 115 having a pair of parallel spaced apart disks 116 transverse thereto. Between the disks 116, the rod 112 is widened between parallel tangent planes so as to define opposite flat surfaces 117 on either side of the rod 115. A C-shaped loading pin connector 118 slides snugly between the plates 116 and onto the opposing flat surfaces 117 so as to be able to slide between the plates 116 guided by the opposite flat surfaces 117. The loading pin connector 118 has apertures 119 through each of its arms into which the loading pins 120 may be threaded. Each of the loading pins is disposed along a longitudinal axis and has a narrow diameter threaded end 121, an intermediate portion 122 which extends somewhat snugly and partly between the disks 116 and a larger diameter portion 123 defining a bearing surface which slides snugly in the arcuate slots 98 provided in the exterior blocking arm wall 97. Thus it will be seen that, when the sliding rod 115 slides along the longitudinal axis of the cylindrical bearing 112, the bearing portions 113 of the loading pins shift arcuately in the slots 98 and the loading pin connector 118 slides between the disks 116 on the sliding rod 115. As can best be seen in FIG. 4, torsion springs 124 mounted on the wider exterior ends of the torsion pin 99 are connected between the limit pin 101 and annular channels 125 in the bearing portions 123 of the loading pins 120. Thus, as can best be seen in FIG. 6, the torsion springs 124 bias the loading pins 120 and therefore the sliding rod 115 toward the lowest point of rotation in the arcuate slots 98.

An adapter 126 is secured to the lower end 127 of the sliding rod 115 by a C-clamp portion 128 secured by a clamp screw (not shown) threaded through apertures 129 in the C-clamp portion 128 of the adapter 126. The adapter 126 has its lower interior portion contoured to snugly receive the grinding block 11 therein with the double stick backing strip 13 exposed to the lens 10.

Figure 8:
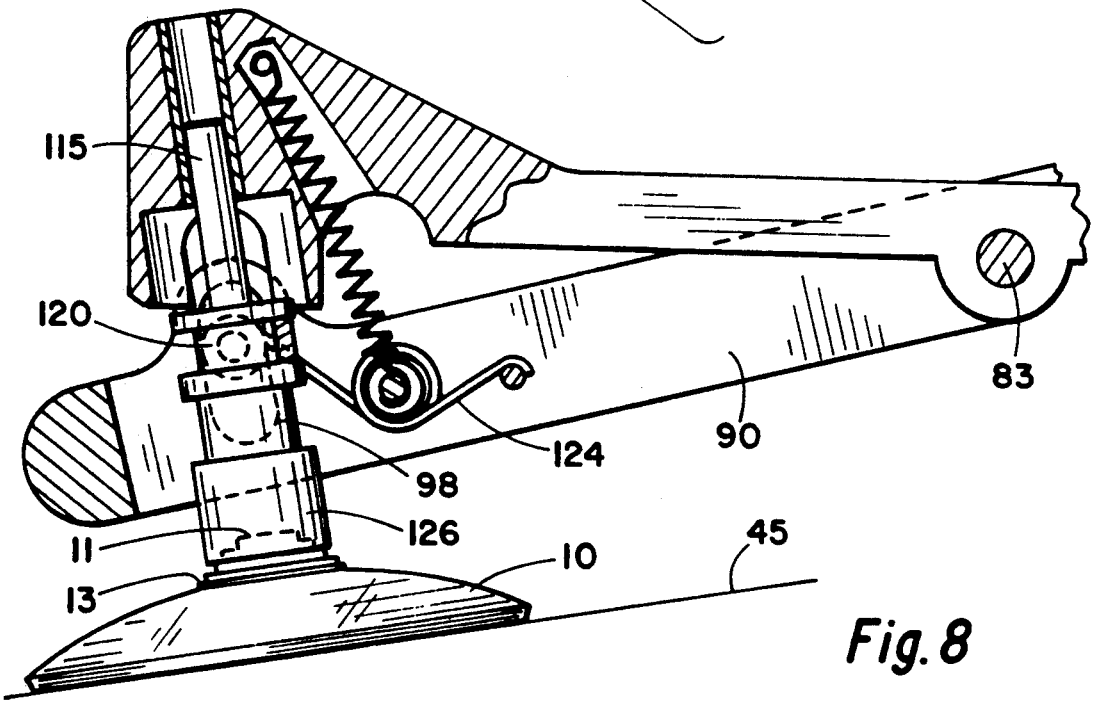
FIG. 8 is a cross-sectional view taken along the same plane as FIG. 6 illustrating the position of the blocker arm components when the outer blocker arm is rotated downwardly to a stop position.
Figure 7:
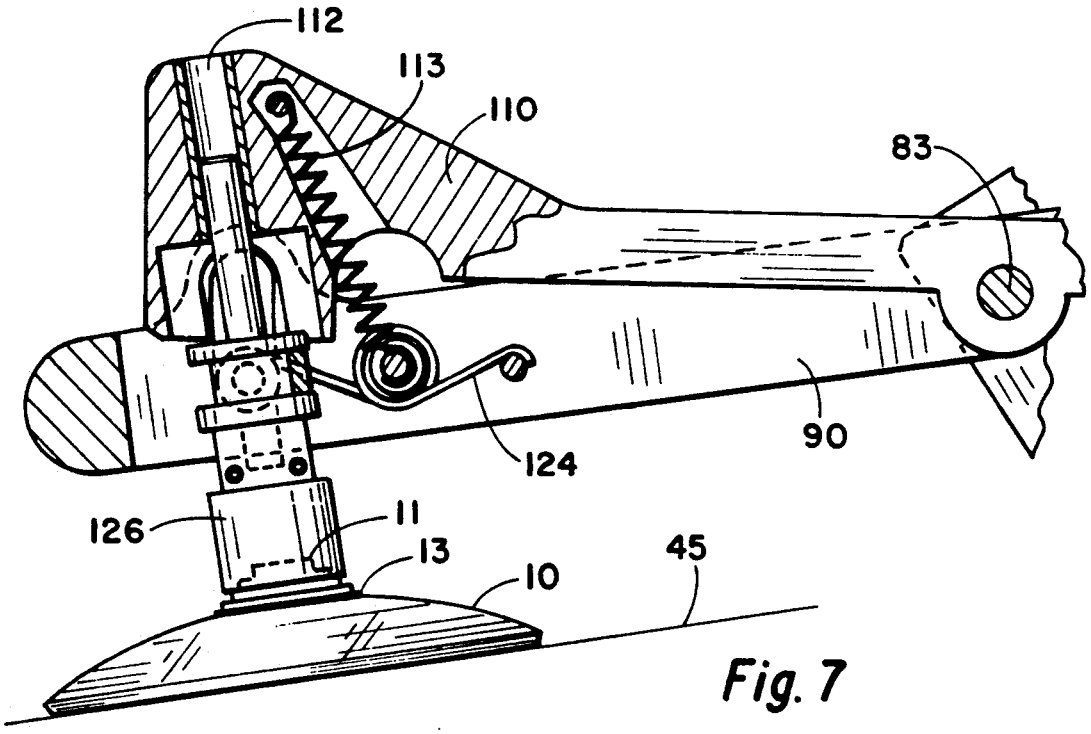
FIG. 7 is a cross-sectional view taken along the same plane as FIG. 6 illustrating the position of the blocker arm components as the grinding block contacts the lens surface.

The operation of the mechanical portion of the blocker can best be understood in reference to FIGS. 1, 6, 7 and 8 which illustrate its operational sequence. Looking first at FIG. 1, with the blocker arms 80 rotated under the force of the biasing spring 94 to their uppermost position within the alignment tower 70, the operator views the target on the work surface 40 through the peep hole 74 in the alignment tower and positions the lens 10 appropriately over the target and on the non-slip sheet 45 as has been hereinbefore described. With the lens 10 located as illustrated in FIG. 6, the handle 96 is moved downwardly by the operator, drawing the exterior blocking arm 90 against the tension of one helical spring 94 while simultaneously drawing the interior compliant arm 110 in response to the tension of the other helical spring 113 connected between the exterior blocking arm 90 and the interior compliant arm 110. At the same time, the torsion springs 124 bias the loading pins 120 to their lowest position in the arcuate slots 98. As seen in FIG. 7, the exterior blocking arm 90 and interior compliant arm 110 will continue to downwardly rotate substantially in unison until the sliding rod 115 is substantially perpendicular to the work surface and the arcuate slots 98 align to permit displacement of the compliant arms 110 relative to the blocker arm 90, in the general angular position achieved when the double stick backing strip 13 makes contact with the surface of the lens 10. At this point, the rearward end of the exterior blocking arm 90 is not rotated upwardly sufficiently to come into contact with the stop bar 86 shown in FIGS. 2 and 3. At substantially the point of rotation when the strip 13 contacts the surface of the lens 10, the axis of the cylindrical bearing 112 should be substantially perpendicular to the plane of the non-slip sheet 45 disposed on the work surface 40. Thus, the grinding block 11 will be substantially in its optimal position for best adhesion to the lens 10 regardless of the depth of the particular lens involved, as will be hereinafter illustrated. At this point, the interior compliant arm 110 lags behind the exterior blocking arm 90 as the rod 115 comes into its perpendicular sliding position in relation to the work surface 40. In FIG. 8, as the downward rotation of the handle 96 continues the downward motion of the exterior blocking arm 90 after the grinding block 13 has contacted the lens 10, the loading pins 120 begin to rotate upwardly in the arcuate slots 98. The force exerted through the downwardly rotated handle 96 on the exterior blocking arm 90 is therefore not applied to the sliding rod 115. That is, as the loading pins 120 ride upwardly in the arcuate slot 98, the only downward pressure exerted on the loading pins 120 and therefore on the lens 10 and the work surface 40 is the force exerted by the torsion springs 124 on the loading pins 120. As the exterior blocking arm 90 continues to rotate downwardly, the rearward end of the exterior blocking arm 90 comes into contact with the underside of the stop bar 86 shown in FIGS. 2 and 3, an event which occurs prior to the loading pins 120 reaching the uppermost possible position in the arcuate slots 98. Therefore, the only force ever exerted upon the lens 10 to secure the grinding block 11 to the lens 10 is the limited predetermined force of the torsion springs 124, thus minimizing the possibility of damage to the lens 10 or to the work surface 40. That is, the torsion springs 124 function as a load limiter to establish the maximum force that will be exerted on the lens 10 and the work surface 40 during the mounting of the grinding block 11 on the lens 10.

Figure 20:
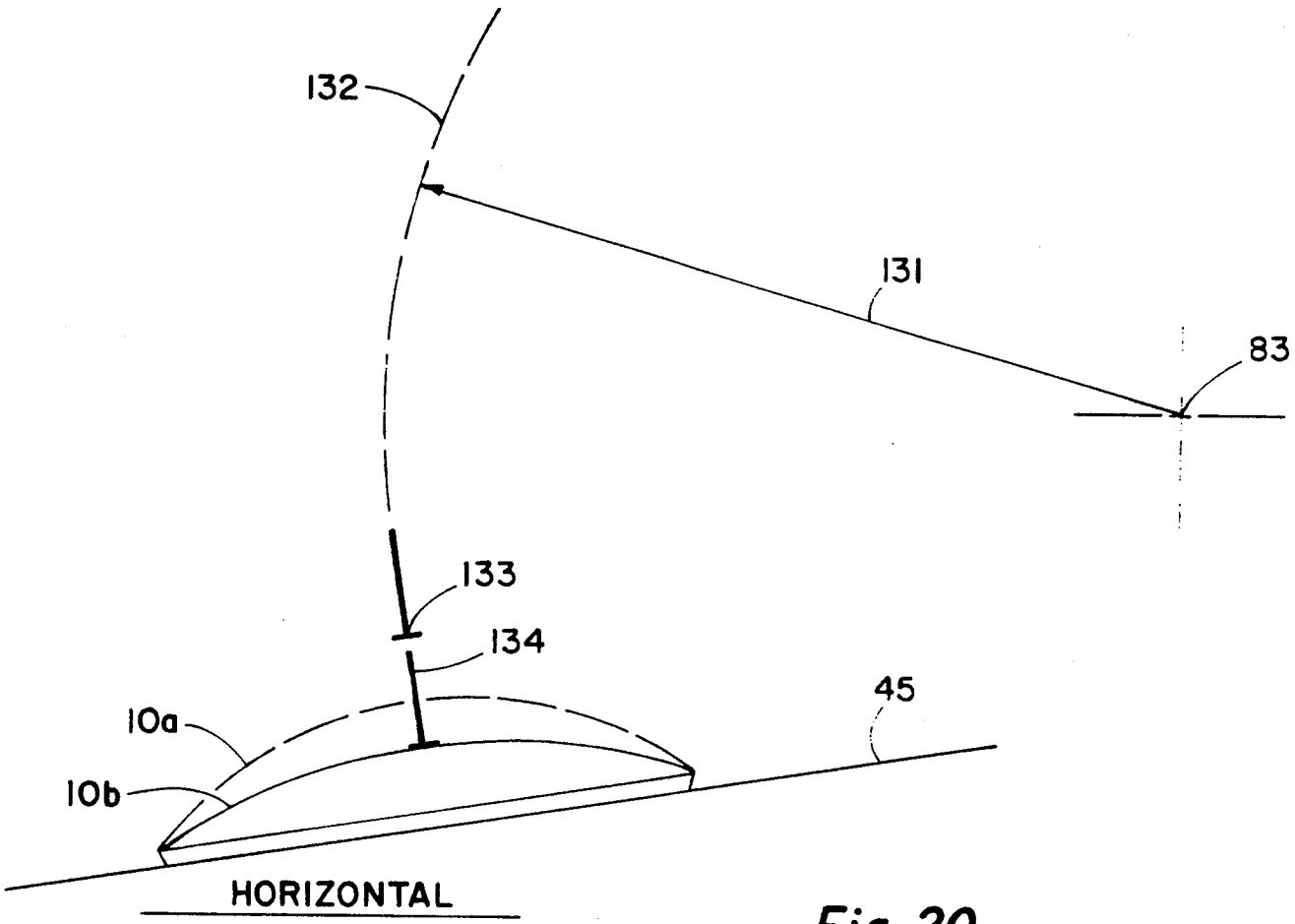
FIG. 20 is a one-line illustration of the path of travel of the center point of the grinding block during the operation of the lens block of FIG. 1.

The motion of the blocking arms 80 can best be understood by reference to FIG. 20 which traces the path of travel of the center of the grinding block 11 as the blocker arms 80 rotate downwardly toward the lens 10. At the beginning of travel, the center of the grinding block 11 will pass at a radius 131 from the axis of the pivot pin 83 along an arc 132 which is circular to a break point 133 above the lens to be blocked. The break point 133 occur at the time that the sliding rod 115 disposed in the cylindrical bearing 112 has its longitudinal axis fall normal to the plane of the work surface 40 and non-slip sheet 45. When the rod 115 aligns along this normal axis 134, the interior compliant arm 110 displaces from the exterior blocking arm 90 and the rod 115 and therefore the center of the grinding block 11 continue along the normal 134 guided by the cylindrical bearing 112. The arc of the arcuate slots 98 is coordinated with the arc of travel such that a tangent to the arcuate slots 98 aligns with the normal 134 at the break point 133 in such a position that the break point 133 must occur at a distance along the normal 134 above the work surface 4 which is greater than the depth of the most curved lens blank 10A that would be blocked by the device. Furthermore, the travel of the blocking arm 90 is permitted to continue to a point along the normal 134 which is closer to the work surface 4 than the surface of the least curved lens blank 10B that will be blocked by the device, though the stop bar 86 prevents rotation of the blocking arm 90 to a point where contact would be made with the work surface 40. Thus, the range of overtravel or of application of constant force to the lens blank 10 extends over a distance greater than the difference between the depth of the greatest and least curved lens blanks 10A and 10B.

With the grinding block 11 secured to the lens 10 by the double stick backing strip 13, the grinding block 11 is released from the adapter 126 as the handle 96 is upwardly rotated, moving the exterior blocking arm 90 to engage the loading pins 120 on the lower portion of the arcuate slots 98 and permitting the blocker arms 80 to be moved in unison under the influence of the bias spring 94 to the maximum elevation position within the alignment tower 70.

Thus, it is apparent that there has been provided, in accordance with the invention, a lens blocker apparatus and procedure that fully satisfies the objects, aims and advantages set forth above. While the invention has been described in conjunction with a specific embodiment and procedure, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A lens blocker for securing a grinding block on a lens blank selected from a variety of lens blanks on a desired location displaced from an optical center of the selected lens blank permitting the lens to be ground to fit a frame rim of known contour comprising:

a work surface having known refraction characteristics and a point of origin thereon;

means for electronically displaying an image of a type of target suited to alignment with the selected lens blank on said work surface;

means spaced from said work surface and aligned on a sight line extending through said point of origin for visual observation of said work surface; and computer means for calculating the displacement between the desired location and the selected lens blank optical center, for compensating in said calculated displacement for parallax resulting from said sight line space and said refraction characteristics and for shifting the location of said image by said compensated, calculated displacement in relation to said point of origin whereby the desired location on the selected lens blank coincides with said point of origin when the selected lens blank is oriented on said work surface to visually coincide through said observation means with said shifted image.

2. A lens blocker according to claim 1, said computer means further for calculating offsets in said displacement compensating for differences between pupillary symmetry of a patient and the frame and for shifting the location of said image by said calculated offsets.

3. A lens blocker according to claim 1, said displaying means further for displaying an image of the frame rim on said work surface and said computer means further for calculating a pupillary position of a patient in relation to said frame rim image and for shifting said frame rim image to cause said pupillary position to coincide with said point of origin, whereby the compatibility of the selected lens blank with the frame rim contour is visually observed.

4. A lens blocker according to claim 1, said computer means further for permitting operator selection of said suitable target image from a plurality of target images stored in a memory of said computer means.

5. A lens blocker according to claim 1, said work surface comprising a glass panel and a non-slip sheet of material resting thereon.

6. A lens blocker according to claim 5, said displaying means comprising an LCD display disposed beneath said work surface.

7. A lens blocker according to claim 6, said sight line being normal to work surface.

8. A lens blocker according to claim 7, said work surface being disposed in a plane tilted upwardly and outwardly from the blocker.

9. A lens blocker according to claim 1 further comprising means mounted in fixed relationship to said work surface for securing a grinding block on the desired location of the lens blank when said lens blank is oriented on said work surface to visually coincide through said observation means with said shifted image.

10. A lens blocker according to claim 9, said securing means comprising:

a frame;

a blocker arm having an adapter for releasably holding a grinding block therein mounted proximate one end thereof and being pivotally mounted on said frame proximate another end thereof for rotation of said adapter between said observation means and said work surface along a plane transverse to said work surface and passing through said sight line such that the grinding block is substantially parallel to said work surface when the block contacts the lens blank.

11. A lens blocker according to claim 10, said adapter being slidably mounted on said arm for reciprocal motion along an arcuate path having a tangent substantially normal to said work surface when the block contacts the lens blank.

12. A lens blocker according to claim 11 further comprising means for biasing said adapter toward said work surface whereby, when the block contacts the lens blank, the force on the lens blank is limited to the force exerted by said biasing means.

13. A lens blocker according to claim 12 further comprising means mounted on said frame and cooperable with said arm for preventing said arm from rotating to exert force on said adapter after the grinding block contacts the lens blank.

14. A lens blocker according to claim 13 further comprising means for maintaining movement of said adapter along an axis substantially normal to said work surface when the grinding block is in contact with the lens blank.

15. A lens blocker according to claim 14, said maintaining means comprising:

a second arm independently pivotally mounted on said frame for rotation about a common axis with said blocker arm;

a bearing disposed in said second arm along said normal axis; and a rod connected to said adapter and slidably disposed in said bearing.

16. A lens blocker according to claim 15, said second arm being connected to said blocker arm by a biasing means for causing said second arm to rotate with said blocker arm.

17. A lens blocker according to claim 16 further comprising means connected between said frame and said blocker arm for biasing said blocker arm to rotate said one end thereof away from said work surface.

18. A lens blocker according to claim 17 further comprising a handle fixed to said blocker arm for manual urging of said blocker arm against said blocker arm biasing means.

19. A process for securing a grinding block on a lens blank selected from a variety of lens blanks on a desired location displaced from an optical center of the selected lens blank permitting the lens to be ground to fit a frame rim of known contour comprising the steps of:

electronically displaying an image of a type of target suited to alignment with the selected lens blank on a work surface having known refraction characteristics and a point of origin thereon;

calculating the displacement between the desired location and the selected lens blank optical center;

compensating in said calculated displacement for parallax resulting from said refraction characteristics over a sight line extending from a sight line observation device to said work surface at said point of origin;

shifting the location of said image by said compensated, calculated displacement in relation to said point of origin;

observing said work surface through said observation device; and orienting the selected lens blank on said work surface to visually coincide through said observation means with said shifted image, whereby the desired location on the selected lens blank coincides with said point of origin.

20. A process according to claim 19 further comprising the steps of:

calculating offsets in said displacement compensating for differences between pupillary symmetry of a patient and the frame; and shifting the location of said image by said calculated offsets.

21. A process according to claim 19 further comprising the steps of:

displaying an image of the frame rim on said work surface;

calculating a pupillary position of a patient in relation to said frame rim image;

shifting said frame rim image to cause said pupillary position to coincide with said point of origin; and visually comparing the oriented selected lens blank with the frame rim image.

22. A process according to claim 19 further comprising the step of selecting said suitable target image from a plurality of target images stored in a memory of a computer.

23. A process according to claim 19 further comprising the step of transversely centering a grinding block on said sight line proximate said oriented lens blank.

24. A process according to claim 23 further comprising the step of pressing said grinding block along said sight line from said centered position onto said oriented lens blank with an adhesive material disposed therebetween.

25. A process according to claim 24 further comprising the step of limiting the force applied by said grinding block to said lens blank.

* * * * *